United States Patent [19]

Smith et al.

[11] 3,981,225

[45] Sept. 21, 1976

[54] LAUNCHER ARRANGEMENT FOR ROCKET POWERED ROUND

[76] Inventors: Matthew S. Smith, 4400 Sarah, Apt. 29, Burbank, Calif. 91505; Ernest A. Filippi, 5859 E. Ida Place, Greenwood Village, Englewood, Colo. 80110

[22] Filed: Mar. 24, 1975

[21] Appl. No.: 561,474

Related U.S. Application Data

[63] Continuation-in-part of Ser. No. 364,658, May 29, 1973, Pat. No. 3,886,841.

[52] U.S. Cl. ..... 89/1.818; 42/1 F; 89/1 F; 89/1.819; 102/49.7

[51] Int. Cl.[2] ..... F41F 3/04

[58] Field of Search ..... 42/1 F; 89/1 F, 1.8, 89/1.818, 1.819; 102/65.2, 49.7

[56] References Cited

UNITED STATES PATENTS

| | | | |
|---|---|---|---|
| 2,944,486 | 7/1960 | Jasse | 102/49.1 |
| 3,082,666 | 3/1963 | Fitzpatrick et al. | 89/1.819 X |
| 3,166,979 | 1/1965 | Draim | 102/49.7 X |
| 3,388,666 | 6/1968 | Walther | 102/49.7 |
| 3,550,501 | 12/1970 | Munger et al. | 89/1 F X |
| 3,570,365 | 3/1971 | Bornand | 42/1 F X |
| 3,610,091 | 10/1971 | Bornand | 89/1 F |
| 3,620,162 | 11/1971 | King | 42/1 F UX |

FOREIGN PATENTS OR APPLICATIONS

| | | | |
|---|---|---|---|
| 662,429 | 12/1951 | United Kingdom | 102/49.1 |

*Primary Examiner*—David H. Brown
*Attorney, Agent, or Firm*—Don B. Finkelstein

[57] ABSTRACT

A launcher for a rocket powered round in which the launcher has a launch cartridge coupled thereto and the launch cartridge is insertable into the tailpipe of the round. The launch cartridge has a launch cartridge charge and an initial launch volume intermediate the launch cartridge charge and the round. A probe is coupled to the launch cartridge and extends into the nozzle of the rocket powered round to reduce the gas passage area therethrough during at least a first portion of the launch phase thereof. The probe may be permanently attached to the launch cartridge and thus remain part of the launcher or the probe may be detachably mounted on the launch cartridge and is driven into nozzle sealing relationship to the nozzle when the round is launched to prevent ignition of the rocket propellant grain.

15 Claims, 5 Drawing Figures

LAUNCHER ARRANGEMENT FOR ROCKET POWERED ROUND

REFERENCE TO RELATED APPLICATIONS

This application is a Continuation-in-Part of Copending Application Ser. No. 364,658, Filed May 29, 1973 now U.S. Pat. No. 3,886,841, issued June 31, 1975 entitled IMPROVED ROCKET BOOSTED ROUND, and is related to Copending Patent Application Ser. 307,444, Filed Nov. 17, 1972 entitled WEAPON ARRANGEMENT and to Copending Patent Application Ser. No. 364,861, Filed May 29, 1973 now U.S. Pat. No. 3,915,091 issued Oct. 28, 1975 entitled IMPROVED ROCKET BOOSTED ROUND. The technology and teaching of these copending Patent Applications are incorporated herein.

BACKGROUND OF THE INVENTION

1. Field of the Invention

This invention relates to the launcher art and more particularly to an improved spike type launcher arrangement for launching a rocket powered round.

2. Description of the Prior Art

The above mentioned copending patent application Ser. No. 364,658 describes a rocket powered round launched from a spike launcher. As disclosed therein the spike type launcher has a spike that is inserted into the tailpipe of a rocket powered round and a launch cartridge is between the spike and the round. An initial launch volume is provided between the launch cartridge and the round to control the pressure of the launch gases exerted on the round for launching thereof. Additionally, there is disclosed in the copending patent application Ser. No. 364,658 a probe means coupled to the launch cartridge, which probe means extends into the nozzle of the round to descrease the nozzle area during the launch phase and thus limiting the impingement on the rocket grain of the hot pressurized launch gases. This has been found desirable to prevent too sudden ignition of the rocket propellant grain. Too rapid ignition of the rocket propellant grain not only endangers the firing personnel by subjecting them to the hot rocket exhaust but also, depending upon the type of launch cartridge utilized, can tend to fracture or rupture the grain during launch because of over pressurization thereof. Therefore, the pressure reduction probe reduces both pressure and the amount of the gases that are transferred into the rocket propellant grain during a first portion of the launch phase thereof. The launch cartridge in copending Patent Application Ser. No. 364,658 is left at the end of the launcher when the rocket powered round is launched.

Therefore, while the above mentioned copending Patent Application Ser. No. 364,658 describes and broadly claims the structure for launching the round and leaving the launch cartridge adjacent to the launcher, it has also been found that in some applications it may be desirable to couple the launch cartridge directly to the launcher. While copending Patent Application Ser. No. 364,658 covers by its claims basic structure for the launch cartridge either coupled to the launcher or as a separate item between the launcher and the round in the tailpipe of the round, the present invention defines more specifically the detailed structure found particularly advantageous by applicant for effectuating a coupling of the launch cartridge to the launcher itself. Therefore, the present invention is concerned with the structural modification to a launcher to achieve the desired safety and high reliability for launching the rocket powered round.

SUMMARY OF THE INVENTION

Accordingly, it is the object of the present invention to provide an improved launcher for launching a rocket powered round.

It is another object of the present invention to provide an improved spike type launcher for launching a rocket powered round.

It is yet another object of the present invention to provide an improved spike type launcher for launching a rocket powered round in which the launch cartridge is coupled to the launcher itself.

The above, and other objects of the present invention, are achieved, in the preferred embodiment, by providing a launch cartridge coupled to the launcher structure. The launch cartridge has an elongated body means that is slidably insertable into the tailpipe of a rocket powered round.

The round to be fired from the launcher is of the type having a rocket motor comprising a rocket propellant grain a nozzle block, and the nozzle block has a nozzle passage way therethrough with walls defining a convergent section, divergent section and a throat area. The round may be of the type described in copending patent Application Ser. No. 364,658. As such, it may be provided with aero gyro stability which, as utilized herein is defined to mean the condition when the center of the pressure of the round is aft of the center of gravity there is a spin rate of the rocket powered round that is at least one order of magnitude larger than the yawing frequency of the rocket powered round when the rocket powered round is in the non spin condition. A ring tail having canted fins may be utilized to provide the desired spin rate.

The body means of the launch cartridge is provided with first walls defining a gas transfer passage extending from the forward to the aft end thereof. The gas transfer passage defines at least a first portion of an initial launch volume. The body means is also provided with second walls defining a launch cartridge charge means cavity in which a launch cartridge charge means may be inserted. The launch cartridge charge means may be of any conventional type such as, for example, the M-169 40 milimeter launch cartridge, or the like.

A probe means is coupled to the forward end of the body means of the launch cartridge and is coaxially aligned and extends into the nozzle throat of the round when the round is mounted on the launcher prior to launching. The probe has a predetermined axial length for extending only a predetermined distance into the round and has a predetermined cross sectional area less than the throat area of the nozzle. This reduces the gas passage area through the nozzle passage way and thus lowers the pressure and limits the amount of launch gases that come in contact with the propellant grain during a first portion of the launch phase. The first portion of the launch phase is, of course, that portion where the probe is still extending into the nozzle and the body means is still extending into the tailpipe. Preferably, the length of the probe is less than the distance that the body means extends into the tailpipe so that the second part of the launch phase occurs when the nozzle is clear of the probe thus opening the nozzle to the full area for gas passage therethrough to impinge upon the rocket propellant grain but the round still has not cleared completely the body means of the launch cartridge.

A conventional firing mechanism of the type usually employed to prior a launch cartridge charge such as the M-169 launch cartridge charge is part of the launcher arrangement and is well known in the art.

When the rocket round is to be launched the body means of the launch cartridge is slidably inserted into the tailpipe of the round. A spacer may be provided between the end of the body means of the launch cartridge and the nozzle of the round to provide a second portion of the initial launch volume therebetween or, in another embodiment of the present invention, the spacer may be eliminated and the nozzle abutts directly against the end of the launch cartridge. In such an embodiment the gas transfer passage way between the launch cartridge charge cavity and the forward end of the body means comprises the initial launch volume.

To launch the round the firing mechanism is actuated which ignites the launch cartridge charge means. Hot pressurized launch gases are thereby generated, which flow into the gas transfer passage way. The gas transfer passage way comprises at least a portion of the initial launch volume. Therefore, these hot pressurized launch gases flow into the initial launch volume wherein the pressure and temperature thereof are decreased by a predetermined amount depending upon the size of the initial launch volume. The launch gases exert a force on the rocket nozzle for launching the round from the launcher and a small amount flows past the probe and into the rocket propellent grain to initiate ignition thereof. Because of the reduced pressure and amount of these hot pressurized gases initially entering the rocket grain, a soft or slow initiation of combustion thereof is achieved. At the end of the first portion of the launch phase, the round has cleared the probe but is still on the body means of the launch cartridge. Once the probe is clear of the round, the full area of the nozzle throat is available for either allowing additional launch gases to impinge upon the grain to accelerate the initial combustion or, depending upon the pressure generated by the products of combustion of the rocket propellent grain, allow sufficient exit area to increase the launch velocity during the second phase of the launch.

During launching, and if the round is preferably provided with the above described aero gyro stabilization, the round spins up to speed so that by the time the round clears the body member of the launch cartridge a full aero gyro stabilization has been achieved.

In another embodiment of the present invention the probe is made detachable from the body means of the launch cartridge by means of a removable pin means extending through the launch cartridge and the probe. In this embodiment, which may be utilized when it is desired to have a pure ballistic trajectory of the round and not have rocket ignition at all, the pin is removed prior to insertion of the round on the launcher. When the launch cartridge charge means is ignited the hot pressurized launch gases generated thereby drive the probe into the rocket nozzle. A resiliently deformable plug means is mounted on the probe to seal the nozzle and thus prevent entirely any launch gases from entering the rocket propellent grain and thereby eliminating rocket propellent grain ignition.

The present invention has found particular utilization in snow avalanche control wherein the round is provided with a warhead and a plurality of rounds are sequentially launched from the launcher into a dangerous snow bank or the like to induce a controlled avalanche and thus remove the possibilities of undesired or uncontrolled avalanches. By incorporating the above described structural arrangement of the launcher arrangement having the launch cartridge coupled thereto, economy is achieved since only the launch cartridge charge means need be replaced for each firing.

BRIEF DESCRIPTION OF THE DRAWINGS

The above and other embodiments of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
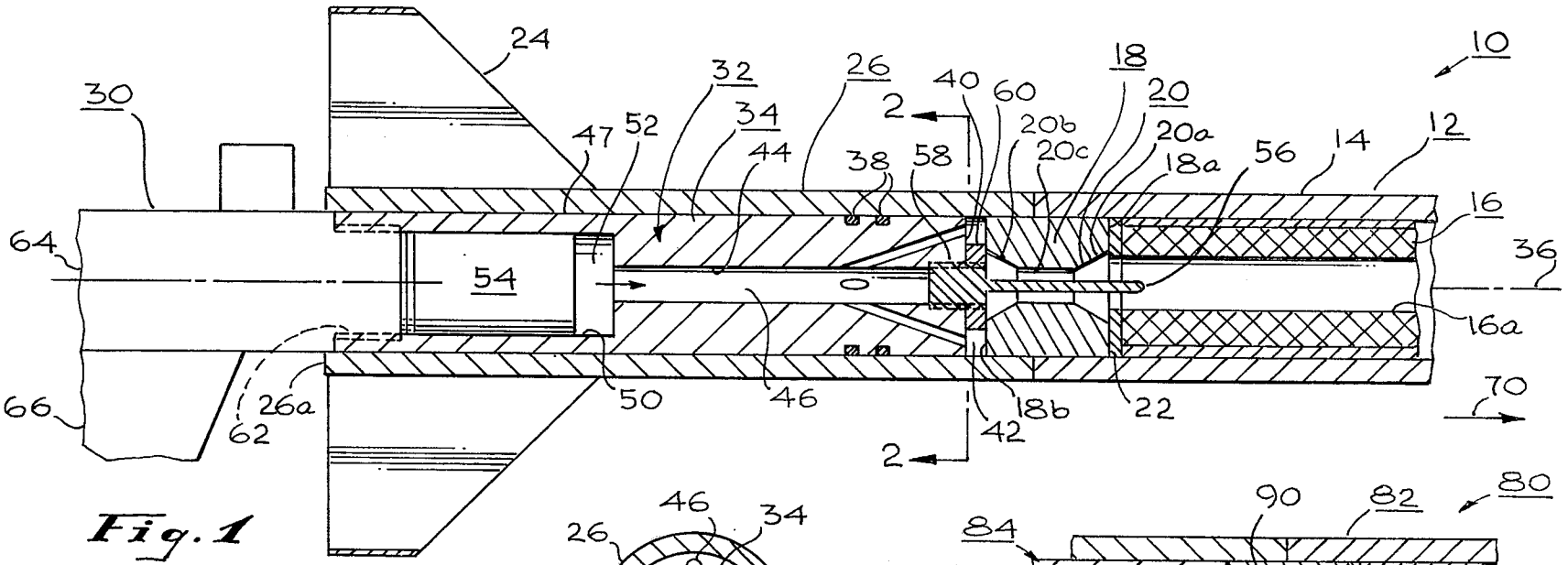
FIG. 1 is a sectional view illustrating a preferred embodiment of the present invention.

Referring now to FIG. 1, there is illustrated one embodiment, generally designated 10 of the present invention. As shown on FIG. 1, there is a rocket powered round 12 having a rocket motor 14 provided with a rocket propellent grain 16, a nozzle block 18 having walls 20 defining a nozzle passage having a convergent section 20*a*, a divergent section 20*b* and a throat section 20*c*. The throat section 20*c* has a predetermined area. The forward end 18*a* of the nozzle block 18 is adjacent an inhibitor disc 22 preventing combustion of the rocket propellent grain 16 on the end surfaces thereof. As shown the rocket propellent grain 16 is a radial burning grain and the surfaces 16*a* are the initial surfaces for ignition thereof. The nozzle passage defined by the walls 20 extends from the forward end 18*a* of the nozzle block 18 to the aft end 18*b* thereof and provides communication into the rocket propellent grain 16. In general, the round 12 may be similar to the rocket powered round described in the above mentioned copending patent application Ser. No. 364,658. As such, it may be provided with a ring and fin tail 24 coupled to the aft end 26*a* of a tubular tail pipe 26. The ring and fin tail 24 is utilized as part of the aero gyro stabilization of the round in those embodiments of the present invention where such aero gyro stabilization is desired. As noted above, aero gyro stabilization has been found to provide a greater accuracy in firing than the accuracy achieved with either fin stabilization, spin stabilization, or gyro stabilization.

A launcher generally designated 30 is provided to launch the round 12. The launcher 30 is provided with a launch cartridge means 32 having a body means 34 slidably insertable into the tubular tailpipe 26 of the round 12. In the embodiment 10 the tailpipe 26 and the body means 34 are cylindrical and coaxial along the axis 36.

The body means 34 is insertable a first predetermined axial distance into the tubular tailpipe 32 as discussed below in greater detail. In preferred embodiments of the present invention there is a substantially close fit between the body member 34 and the tubular tailpipe 26 for support of the round 12 on the launcher 30 prior to launching. Additionally, if desired sealing means such as O-rings 38 may be provided to assure a gas tight seal between the body means 34 and tubular tailpipe 26 of the round 12.

The body means 34 has a forward end 40 that is in regions adjacent the aft end 180*b* of the nozzle block 18 of the round 12 when the round 12 is mounted on the launcher 30. The forward end 40 of the body means 34 is, in the embodiment 12 shown in FIGS. 1 and 2, spaced a preselected axial distance from the aft end 18*b* of the nozzle block 18 to define a volume 42 therebetween.

Figure 2:
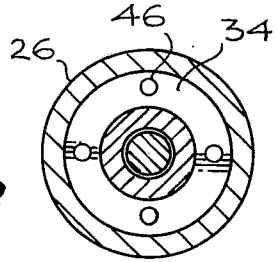
FIG. 2 is a sectional view along the line 2—2 thereof.

The body means 34 is provided with first walls 44 defining a gas transfer passageway 46 extending from the forward end 40 to the aft end 47 of the body means 34 and, in the embodiment 10 shown in FIGS. 1 and 2, the gas transfer passage 46 is divided into four branches communicating with the volume 42 between the body means 34 and the aft end 18*b* of the nozzle block 18.

The body means 34 is also provided with second walls 50 defining a launch cartridge charge means cavity 52 at the aft end 47 of the body means 34 and the launch cartridge charge means cavity 52 is adapted to receive a launch cartridge charge means 54 therein. The launch cartridge charge means may, for example, be a standard M-169 40 millimeter launch cartridge charge, or similar launch cartridge charges. Such devices are well known in the art. The launch cartridge charge cavity communicates with the gas transfer passageway 46 to allow a free flow of the hot pressurized launch gases obtained when the launch cartridge charge means 54 is fired therethrough.

The gas transfer passage 46 has a predetermined volume and this volume is a first portion of an initial launch volume. The volume 42 described above is a second portion of the initial launch volume and together these two volumes comprise the initial launch volume for the embodiment 10 shown in FIG. 1. The size of the initial launch volume is selected from considerations of the type of launch cartridge charge means 54, the type of rocket propellent grain 16 in the round 12, the desired launch velocity and desired time for completion of the launch phase of the round 12. Thus, for example, the larger the initial launch volume the lower will be the pressure exerted by the hot pressurized launch gases for launching the round 12 and therefore there will be a slower launch velocity.

A probe means 56 is coupled to the forward end 40 of the body means 34 by, for example, the threading engagement thereof as indicated at 58. Thus, the probe means 56 is a part of the launch cartridge 32 and remains thereon after launching of the round 12 from the launcher 30.

The probe means 56 is coaxially aligned with the throat 20*c* of the nozzle passage 20 in the nozzle block 18 and has a predetermined axial length selected so that for the condition of the round 12 mounted on the launcher 30 in the position shown in FIG. 1 the probe means 56 extends through the throat area 20*c*. Probe means 56 also has a preselected cross-sectional area and thus reduces the gas passage area in the throat section 20*c*. Thus, the probe acts as a pressure reduction probe to reduce the pressure of the hot pressurized launch gases generated by the fired launch cartridge charge means 54 that impinge upon the walls 16*a* of the rocket propellent grain 16 during the initial portion of the launch phase of the round 12. Further, the reduction in area also limits the amount of hot pressurized gases as well as the pressure thereof that impinge upon the rocket propellent grain 16 during this first portion of the launch phase. The size of the cross-sectional area of the probe 56 at the throat section 20*c* of the nozzle block 18 is selected from the same considerations governing the selection of the initial launch volume 46 as well as, in particular, the type of rocket propellent grain 16 in the round 12. That is, certain rocket propellent grains have a tendency to burst or rupture when subjected to too high an initial igniting pressure from the hot pressurized launch gases. Therefore, the probe cross-sectional area is selected to eliminate the possibility of rocket propellent grain 16 rupture by limiting both the pressure to which it is subjected and the amount of hot pressurized launch gases impinging thereon during the initial portion of the launch phase of the round 12. The axial length of the probe means 56 is selected so that, in preferred embodiments of the present invention, when the round 12 is launched the probe, which remains with the launcher 30, is clear of the nozzle block 18 while the body means 34 is still at least partially inserted into the tailpipe 26 in order to provide stability during the launch phase and to prevent damage to the probe which might occur because of skew firing or thrust misalignment causing the rocket round 12 to deviate from a linear course during launch.

Further, by controlling the amount of hot pressurized launch gases impinging on the wall 16*a* of the rocket propellent grain 16, the time to full thrust of the rocket propellent grain 16 is controlled and the initial launch velocity imparted to the rocket by the launch gases allows the rocket to clear the launcher and operating personnel before full thrust is obtained. Thus, the operating personnel are not subjected to the rocket exhaust at a high level which could be dangerous to operating personnel.

A spacer means 60 is coupled to the probe means 56 by, for example, threading engagement with the probe 56 adjacent to threading engagement at 58 between the probe means 56 and the body means 34. The function of the spacer means 60 is to maintain the aft end 18*b* of the nozzle block 18 spaced the preselected distance from the forward end 40 of the body means 34 to provide the volume 42 therebetween and thus obtain the full desired initial launch volume.

In the embodiment shown in FIGS. 1 and 2 it can be seen that the second walls 50 in the body means 34 defining the launch cartridge charge means cavity 52 are positioned within the tailpipe 26 for the condition of the round 12 mounted on the launcher 30. Thus, for the embodiment 10 shown on FIGS. 1 and 2 it can be seen that this structural arrangement is similar to the structural arrangement shown in copending patent application Ser. No. 364,658, except that the launch cartridge 32 is coupled, for example, by threading engagement as shown at 62 to a firing mechanism 64 which is part of the launcher arrangement 30. Appropriate support means illustrated at 66 may be provided as part of the launcher arrangement 30 for supporting the launcher arrangement 30 in any desired orientation. The firing means 64 is a conventional firing means utilized, for example, for firing the above mentioned M-169 40 millimeter launch cartridge charge.

When it is desired to launch the round 12 from the launcher 30 the body means 34 is inserted into the tailpipe 26 until the spacer means 60 abuts against the nozzle block 180*a*. The firing mechanism means 64 is actuated to fire the launch cartridge charge means 54. The hot pressurized gases generated by the firing of the launch cartridge and charge means 54 flow into the initial launch volume comprised of the volumes 46 and 42 and expand therein thereby lowering the pressure thereof. The lower pressure gases act against the rear face 18*b* of the round 12 to drive the round 12 in the direction indicated by the arrow 70 from the launcher 30. During the initial portion of the launch phase the pressurized launch gases pass around the probe means 56 in the annular area between the probe means 56 and the throat section 20*c* of the nozzle passage 22 in the nozzle block 18 and this restriction further reduces the pressure as well as the flow of the hot pressurized launch gases. Therefore, a comparatively soft and low level ignition of the surfaces 16*a* of the rocket propellent grain 16 is achieved and it commences radial burning. The radial burning of the rocket propellent grain 16 from the surface 16*a* build up to full thrust after the round has left the launcher 30. Thus, the primary launch energy for the round 12 is obtained from the hot pressurized launch gases acting on the round 12. During the launch phase the canted fin and ring tail 24 spins the round 12 to attain, if the round 12 is designed therefor, aero gyro stability.

After firing the expended launch cartridge charge means 54 may be removed and a new one installed. Another round 12 may then be placed on the launcher 30 for rapid repititive firing.

Figure 3:
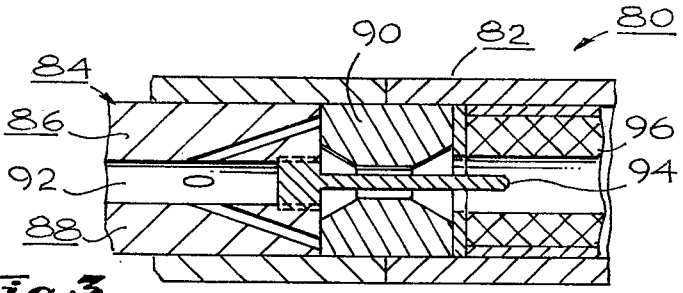
FIG. 3 illustrates another embodiment of the present invention.

Referring now to FIG. 3 there is shown another embodiment of the present invention generally designated 80 in which there is provided a rocket powered round 82 that may be the same as the rocket powered round 12 described above in connection with FIGS. 1 and 2. The launcher arrangement 84 in the embodiment 80 is generally similar to the launcher arrangement 30 and is provided with a launch cartridge means 86 having a body means 88. However, in the embodiment 80 there is no spacer provided between the nozzle 90 of the round 82 and the forward end of the body means 88. In such an embodiment 80 the initial launch volume is obtained from the gas transfer passageway 92 in the body means 88. The probe means 94 may be the same as the probe means 56 described above and further limits the pressure of the hot pressurized launch gases impinging upon the rocket propellent grain 96 of the round 82 in the manner as described above in connection with FIG. 1.

Figure 4:
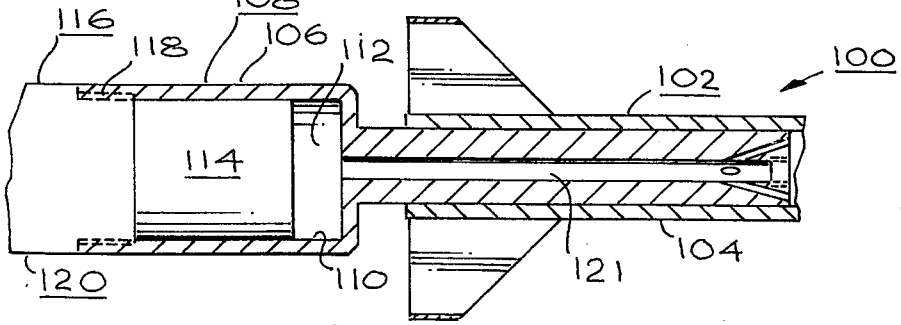
FIG. 4 illustrates another embodiment of the present invention.

FIG. 4 illustrates another embodiment of the present invention generally designated 100 for launching a round 102 which may be similar to the round 12 and the round 82 described above. However, in this embodiment the diameter of the tailpipe 104 of the round 102 is not sufficiently large enough to allow insertion of the aft end 106 of the launch cartridge 108 which is provided with the second walls 110 defining the launch cartridge charge means cavity 112 in which a launch cartridge charge means 114 is provided as part of the launcher arrangement 116. The launch cartridge 108 is coupled, for example, by a threading engagement as shown at 118 to the launcher arrangement 116 at the firing mechanism means 120 thereof, all of which may be similar to the corresponding structure described above in connection with FIG. 1. The gas transfer passage 122 provided in the body mean 106 is similar to the gas transfer passage 46 described above in those structures wherein the arrangement of the embodiment 100 is utilized with a spacer between the end of the body means 106 and the rocket nozzle (not shown in FIG. 4) in a manner similar to that shown in FIG. 1. Alternatively, it may be similar to the gas transfer passage 92 shown in FIG. 3 for those embodiments where no spacer between the rocket nozzle and the body means 106 is provided.

Figure 5:
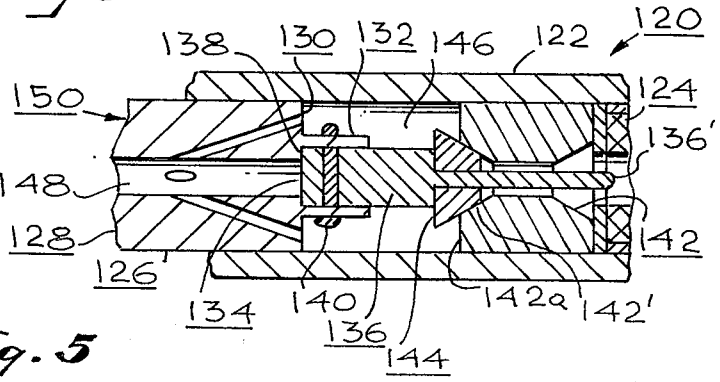
FIG. 5 illustrates another embodiment of the present invention.

In some situations it may be desirable to fire the round without igniting the rocket propellent grain. FIG. 5 illustrates the structure according to the principles of the present invention for achieving this result.

As shown in FIG. 5 the embodiment generally designated 120 may be utilized to launch a rocket powered round 122 which may be similar to the rocket powered round 12 described above in connection with FIG. 1. However, in launching the rocket powered round 122 it may be desired only to provide a pure ballistic trajectory thereof rather than a powered phase of flight. That is, the entire flight of the round 122 is ballistic and is achieved by the action of the hot pressurized launch gases acting thereon as described above. Therefore, the rocket propellent grain 124 in the round 122 is not ignited.

In order to achieve versatility in this invention to allow either firing of the round 122 with ignition of the rocket propellent grain 124 as described above, for example, in connection with FIG. 1, or to prevent ignition of the rocket propellent grain 124, there is provided a modified probe structure coupled to the body means 126 of a launch cartridge means 128 which may be generally similar to the launch cartridge 32 described above with the modifications thereto as herein described. Thus, at the forward end 130 of the launch cartridge 128 there is provided a tubular neck portion 132 into which the aft end 134 of the probe means 136 is inserted. If desired, a shoulder means 138 may be provided on the body means 126 to limit the axial penetration of the probe means 136 therein and provide alignment for purposes hereinafter set forth.

A pin means generally designated 140 extends through the walls of the tubular neck portion 132 and through the probe means 136 to couple the probe means 136 to the launch cartridge 128. The pin means 140 is a removable pin means. The forward portion 136' of the probe means 136 extends through the nozzle 142 of the round 122 in the manner as described above in connection with FIGS. 1, 3, and 4. A nozzle sealing plug means 144 is mounted on the probe means 136 and is adapted to engage the divergent section 142' of the nozzle block 142 for the round 122 mounted on the launch cartridge 128. Thus, the aft end 142*a* of the nozzle 142 is spaced from the forward end 130 of the body means 126 to provide the volume 146 therebetween. The volume 146 together with the volume of the gas transfer passageway 148 together make up the initial launch volume in this embodiment of the present invention.

When it is desired to fire the round 122 and obtain ignition of the rocket propellent grain 124 the removable pin 140 is left in the position shown in FIG. 5 coupling the probe means 136 to the body means 126 where it remains after launch of the round 122 as part of the launcher arrangement generally designated 150. For this condition, that is when the rocket propellent grain 124 is to be ignited, operation proceeds as described above in connection with FIGS. 1, 3, and 4. However, when it is desired to prevent ignition of the rocket propellent grain 124, before mounting the rocket powered round 122 on the body means 126 the removable pin 140 is removed. Frictional forces between the tubular neck portion 132 of the body means 126 and the probe means 136 retain the probe means 136 thereon and in coaxial alignment with the nozzle 142. However, when the launch cartridge charge means (not shown in FIG. 5) is fired in a manner similar to that described in connection with FIG. 1, the hot pressurized launch gases impinge against the rear face 134 of the probe 136 and drive the plug 144 into tight gas tight sealing relationship with the nozzle 142. Thus, the plug 144 is preferably a resiliently deformable plug to allow a tight wedging action of the plug in the divergent section 142'. The frictional forces retaining the probe means 136 on the body means 126 when the removable pin 140 is removed are selected, of course, so that the launch gases drive the plug 144 into the nozzle before gas flows from the volume 146 through the nozzle 142 and into the grain 124. Therefore, the embodiment shown in FIG. 5 allows either a rocket powered flight of the round 122 or a pure ballistic flight of the round 122 when launched from the launcher 150, depending upon the requirements of a particular application.

From the above, it can be seen that there has been provided a new and improved launcher arrangement for launching a rocket powered round. The launch cartridge, in this invention, is coupled to the launcher arrangement and remains therewith after firing of the round. Additionally, in certain embodiments, there has been described structure for providing launching of the round for a pure ballistic trajectory by preventing ignition of the rocket propellent grain in the round. It will be appreciated that the embodiment for achieving such ballistic flight of the round 122 may incorporate the structure shown in FIG. 1 wherein the launch cartridge charge means is within the tailpipe of the round or the structure shown in FIG. 4 wherein the launch cartridge charge means in external the tailpipe of the round.

Those skilled in the art may find many variations and adaptations of the present invention and the appended claims are intended to cover all such variations and adaptations falling within the true scope and spirit of the invention.

We claim:

1. In a launching arrangement having a launcher for launching a rocket powered round by the hot pressurized launch gases generated by an ignited launch cartridge charge means, said rocket powered round of the type having a launch phase and a powered phase of flight, and said rocket powered round having a rocket motor comprising a rocket propellent grain, a rocket nozzle block, said rocket nozzle block having a forward end and an aft end and a nozzle passage way between said forward end and said aft end communicating with said rocket propellent grain, and said nozzle passage way having walls defining a convergent section, a divergent section and a throat section and said throat section having a predetermined throat area, and said rocket propellant round having a tubular tailpipe extending from the rocket nozzle block, the improvement to said launch arrangement comprising, in combination:

a launch cartridge means coupled to said launcher and said launch cartridge means comprising a body means slidably insertable a first predetermined axial distance into said tubular tailpipe of said rocket powered round, and said body means having a forward end adjacent said aft end of said nozzle block of said rocket powered round, and an aft end spaced therefrom;

first walls in said body means defining a launch gas transfer passage way extending between said forward end and said aft end and said gas transfer passage way having a predetermined volume and comprising at least a first portion of an initial launch volume;

second walls in said body adjacent said aft end thereof and defining a launch cartridge charge means cavity for receiving said launch cartridge charge means, and said launch cartridge charge cavity communicating with said gas transfer passage way;

probe means coupled to said forward end of said body means and coaxially aligned with and extending into said throat of said rocket nozzle passageway, and said probe means having a predetermined axial length and a preselected cross sectional area, said preselected cross sectional area of said probe means less than said throat area of said nozzle passage way, to reduce the gas passage area therethrough for the condition of said rocket powered round mounted on said launcher;

whereby the ignition of said launch cartridge charge means generates said hot pressurized launch gases into said gas transfer passage way of said initial launch volume for exerting a launch force on said aft end of said nozzle block to launch said rocket powered round from the launcher and initiate the ignition of said rocket propellant grain.

2. The arrangement defined in claim 1 therein:

said forward end of said body means abuts against said aft end of said nozzle block, and said first predetermined volume of said gas transfer passage way comprises said initial launch volume.

3. The arrangement defined in claim 1 and further comprising:

spacer means coupled to said body means for spacing said aft end of said nozzle block a predetermined axial distance from said forward end of said body means to define a second predetermined volume, said second predetermined volume comprising a second portion of said initial launch volume.

4. The arrangement defined in claim 1 wherein:

said predetermined axial length of said probe means is less than said first predetermined axial distance of insertion of said body means in said tubular tailpipe of said rocket powered round.

5. The arrangement defined in claim 4 wherein:

said launch cartridge means is coaxial with said tubular tailpipe of said rocket powered round and is in frictional engagement therewith to provide a predetermined frictional force therebetween.

6. The arrangement defined in claim 5 and further comprising:

seal means between said body means of said launch cartridge means and said tailpipe of said rocket powered round to provide a substantially gas tight seal therebetween.

7. The arrangement defined in claim 1:

said second walls of said body means defining said launch cartridge charge cavity are in said tailpipe of said rocket powered round for the condition of said rocket powered round mounted on the launcher.

8. The arrangement defined in claim 1 wherein:

said second walls of said body means of said launch cartridge means defining said launch cartridge charge cavity are exterior said aft end of said tailpipe of said rocket powered round for the condition of said rocket powered round mounted on the launcher.

9. The arrangement defined in claim 1 wherein:

said probe means is threadingly coupled to said body means to said launch cartridge means.

10. The arrangement defined in claim 1 wherein:

said probe means is detachably coupled to said body means of said launch cartridge means.

11. In a launcher for launching a round by hot pressurized launch gases generated from a launch cartridge charge means, said round of the type having a rocket motor comprising a rocket propellant grain, a rocket nozzle block having a forward end, an aft end, and walls defining a nozzle passage way between said aft end and said forward end communicating with said rocket propellant grain, and said nozzle passage way defining a convergent section, a divergent section and a throat section, said throat section having a predetermined throat area, and said round having a tubular tailpipe extending from the rocket nozzle block, the improvement to said launcher comprising, in combination:

a launch cartridge means coupled to said launcher and comprising a body means slidably insertable a first predetermined axial distance into said tailpipe of said round, and said body means having a forward end adjacent said aft end of said nozzle block and an aft end spaced therefrom;

first walls on said body means defining a gas transfer passage way in said body means extending between said forward end and said aft end thereof and having a first predetermined volume and comprising a first portion of an initial launch volume;

second walls in said body means adjacent said aft end thereof defining a launch cartridge charge means cavity for receiving said launch cartridge charge means, and said launch cartridge charge cavity communicating with said gas transfer passage way;

a tubular neck portion coupled to said forward end of said body means, and said forward end of said body means spaced a predetermined axial distance from said aft end of said nozzle block means of said round, and communicating with said initial launch volume;

probe means mounted in said tubular neck portion of said body means and coaxially aligned with and extending into said throat section of said nozzle passage way of said round, and said probe means having a predetermined axial length and a preselected cross sectional area less than said throat area of said nozzle passage way to reduce the gas passage area therethrough;

a removable pin means extending through said tubular neck portion of said body means and through said probe means for retaining said probe means on said body means for the condition of said removable pin installed, and said probe means detachable from said tubular neck portion of said body means for the condition of said pin means removed;

a nozzle passage sealing plug means on said probe means intermediate said tubular neck portion of said body means and said aft end of said nozzle block of said round for the condition of said round on the launcher;

whereby ignition of said launch cartridge means generates said hot pressurized launch gases into said gas transfer passage way of said initial launch volume for launching said round from the launcher and driving said probe means into said nozzle block to provide a gas sealing relationship between said plug means and said nozzle passage way of said round for the condition of said removable pin removed to prevent ignition of said rocket propellant grain, and for initiating ignition of said rocket propellant grain for the condition of said removable pin installed.

12. The arrangement defined in claim 11 wherein:

said probe means is retained in said tubular neck portion of said body means by a first predetermined frictional force for the condition of said removable pin removed, and said launch gases exert a second predetermined force greater than said first predetermined force on said probe means to drive said plug means into gas sealing relationship with said nozzle passage of said round.

13. The arrangement defined in claim 11 wherein:

said second walls of said body member are in said tailpipe of said round for the condition of said round on said launcher.

14. The arrangement defined in claim 11 wherein:

said second walls of said body means are external said aft end of said tailpipe for the condition of said round on said launcher.

15. The arrangement defined in claim 11 wherein:

said nozzle sealing plug means is resiliently deformable and is tapered to match said divergent portion of said nozzle passage of said round.

* * * * *